United States Patent [19]

Tietjens

[11] 4,272,884

[45] Jun. 16, 1981

[54] SHAVING APPARATUS

[75] Inventor: Eduard W. Tietjens, Drachten, Netherlands

[73] Assignee: U.S. Philips Corporation, New York, N.Y.

[21] Appl. No.: 70,197

[22] Filed: Aug. 27, 1979

[30] Foreign Application Priority Data

Sep. 18, 1978 [NL] Netherlands ..... 7809462

[51] Int. Cl.[3] ..... B26B 19/14

[52] U.S. Cl. ..... 30/43.6; 30/346.51

[58] Field of Search ..... 30/43.6, 43.5, 346.51, 30/43.92

[56] References Cited

U.S. PATENT DOCUMENTS

| | | | |
|---|---|---|---|
| 3,088,205 | 5/1963 | Ellis | 30/43.6 X |
| 3,962,784 | 6/1976 | Tietjens | 30/346.51 X |
| 4,151,645 | 5/1979 | Tietjens | 30/346.51 X |

*Primary Examiner*—Gary L. Smith

*Attorney, Agent, or Firm*—Thomas A. Briody; William J. Streeter; Rolf E. Schneider

[57] ABSTRACT

A shaving apparatus comprises a cutting unit provided with at least one cutter having associated therewith a lead cutter movable relative to the cutter. The lead cutter is connected to the cutter by means of a connecting element formed of a material having rubber-elastic properties.

2 Claims, 6 Drawing Figures

SHAVING APPARATUS

This invention relates to a shaving apparatus having a cutting unit with at least one cutter which is equipped with a lead cutter which is movable relative to the cutter.

Such a shaving apparatus is for example known from United States patent application No. 3,962,784. The lead cutter serves to take along a hair which lies against the lead cutter during the movement of the lead cutter relative to the cutter, so that the cutter cuts the hair when it is slightly pulled out of the skin, thus yielding a better shaving result.

The lead cutter should be positioned accurately relative to the cutter. Under the influence of the forces exerted on it by a hair, the lead cutter should be movable relative to the cutter, but when these forces cease the lead cutter should return to its initial position. This results in an intricate construction of the cutting unit.

The present invention provides a simplified construction which is characterized in that the lead cutter is connected to the cutter by means of a connecting element of a material with rubber-elastic properties.

A special embodiment is characterized in that the connecting element takes the form of a rubber layer between the cutter and the lead cutter.

The invention is also embodied in a cutting unit as used in the embodiments described in the foregoing.

The invention will now be described in connection with the accompanying drawings, in which.

Figure 1:
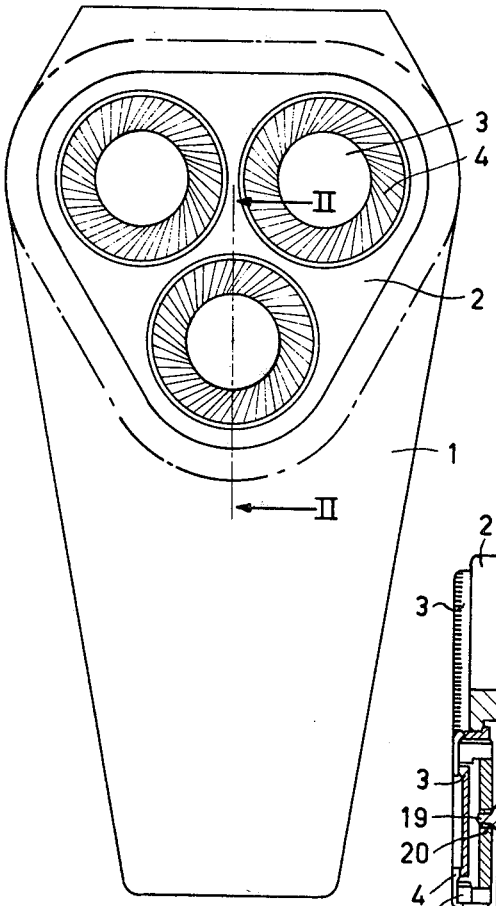
FIG. 1 is an elevation of a shaving apparatus having three cutting units.
Figure 2:
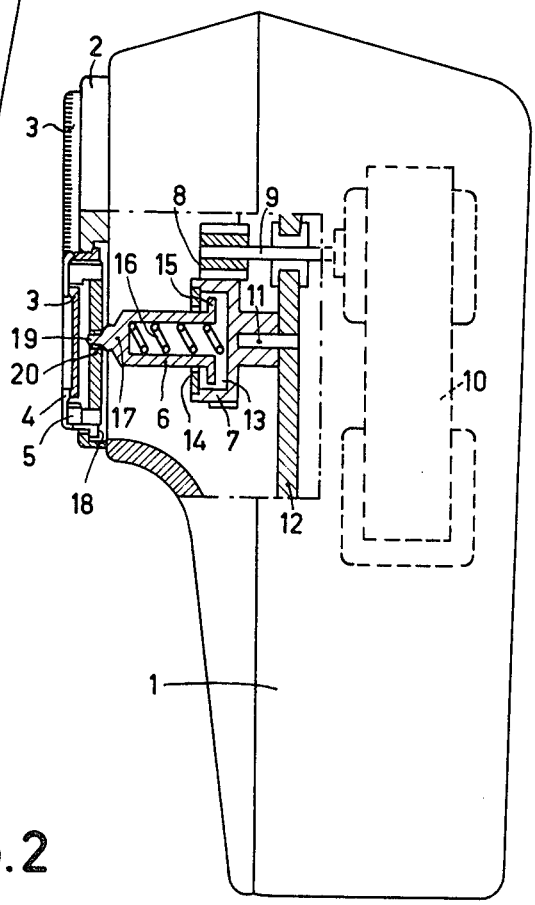
FIG. 2 shows the shaving apparatus of FIG. 1 in side view and partly in a cross-section taken on the line II—II in FIG. 1.

The shaving apparatus in accordance with FIGS. 1 and 2 comprises a housing 1, of which a part takes the form of shear plate holder 2 for three shear plates 3. The shear plates 3 are provided with hair entry apertures 4.

As is shown in the partial cross-section of FIG. 2 a cutting unit 5 is situated on the inner side of a shear plate 3. This cutting unit 5, which for the sake of clarity is shown only schematically in FIG. 2, comprises a cutting member with cutters and lead cutters and is shown in perspective and on an enlarged scale in FIG. 3.

By means of the hollow spindle 6 (FIG. 2), the gear wheels 7 and 8, and the spindle 9 the cutting unit 5 is coupled to the electric motor 10, so that the cutting unit is rotatable relative to its associated shear plate 3. The gear wheel 7 is rotatably journalled on a pin 11, which is mounted in a mounting plate 12. The gear wheel 7 has a recess 13 which is closed by the cover plate 14. This recess accomodates the flange 15 at the end of the hollow spindle 6. By giving the flange 15 a nonround, for example square, shape and by accordingly shaping the recess 13, a coupling is obtained for the transmission of the rotary movement from the gear wheel 7 to the spindle 6, the spindle being pivotal in all directions. The spring 16, which for its greater part is situated in the hollow spindle 6 and which is tensioned between the hollow spindle 6 and the gear wheel 7, exerts a force on the spindle 6 in the direction of the cutting unit 5. As the cylindrical portion 17 of the spindle 6 bears against the cutting unit 5, this force is exerted on the cutting unit and via the cutting unit on the shear plate 3, so that the shear plate is pressed against the shear plate holder 2 by means of its rim 18. As a result of external forces that may occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 is provided with an end 19 of substantially rectangular cross-section. This end 19 is situated in a corresponding coupling aperture 20 of the cutting unit 5.

The coupling to the electric motor 10 as described in the foregoing is identical for the three cutting units of the apparatus in accordance with FIGS. 1 and 2, three gear wheels 7 being in engagement with a single centrally disposed gear wheel 8 on the moter spindle 9.

The cutting unit 5 (FIG. 3) is essentially constituted by a central body 21 provided with circumferential cutters 22 which are respectively connected to the central body 21 by means of arms 23. The central body 21 is provided with the coupling aperture 20. Each cutter 22 is provided with a lead cutter 24 which leads in the direction of driving P, a connecting element 25 in the form of a rubber layer being interposed between the cutter and the lead cutter. This rubber layer adheres both to the cutter 22 and to the lead cutter 24. The cutters 22 each have a cutting edge 26, whilst the lead cutters 24 are each provided with a sharp edge 27.

Figure 4:
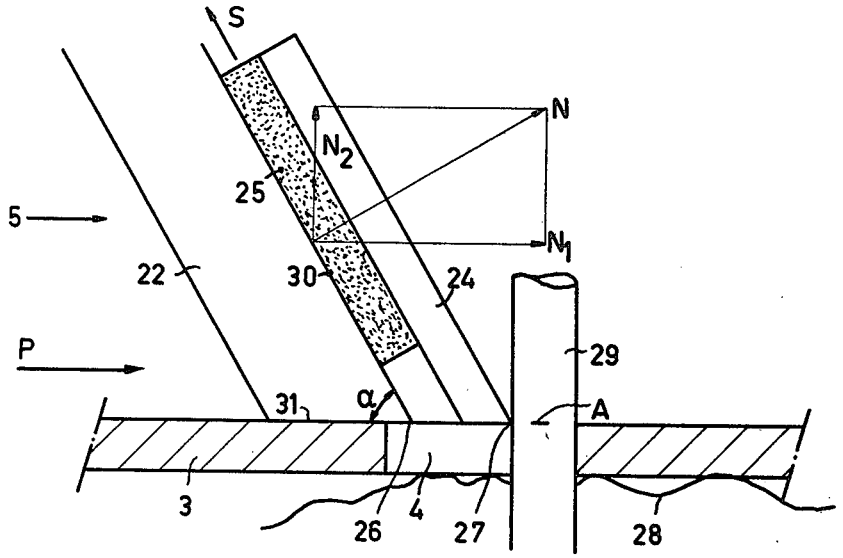
FIGS. 4 and 5 illustrate the operation of the lead cutters.
Figure 5:
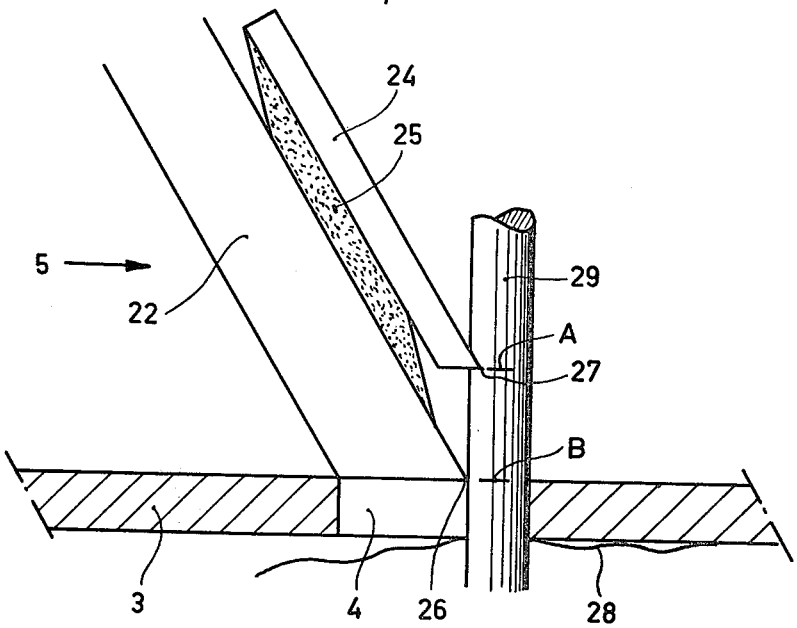

FIGS. 4 and 5 illustrate the operation of the cutting unit and schematically show a side view of a part of the cutting unit 5 and a part of a shear plate 3, whilst furthermore a skin portion 28 with a hair 29 is shown. If a hair 29 is caught in a hair entry aperture 4, the rotary movement of the cutting unit 5 will soon cause this hair to come into contact with the sharp edge 27 of a lead cutter 24 at the location A. The sharp edge 27 is constructed so that it will slightly penetrate the hair 29, without cutting the hair. The direction of the reactive force which is exerted on the lead cutter 24 by the hair 29 is opposed to the direction of movement P. This force is compensated for by the component $N_1$ of the normal force N which is exerted on the connecting element 25 by the wall 30 of the cutter 22 and on the lead cutter 24 by the connecting element (FIG. 4). As a result of the rubber-elastic properties of the rubber layer which constitutes the connecting element 25, this connecting element can transfer only small shear forces in the direction S between the cutter 22 and the lead cutter 24 in the undeformed condition of said element. The component $N_2$ of the normal force N causes the lead cutter 24 to move relative to the cutter 22 in the direction S. The angle $\alpha$ between the wall 30 and the wall 31 of the cutter 22 which engages with the shear plate 3 is smaller than 90°.

As a result of inter alia the natural elasticity of the skin the hair 29 will be moved along by the lead cutter 24 until the cutting edge 26 of the cutter 22 has reached the hair at the location B (FIG. 5). Subsequently, the hair 29 will be cut by co-operation of the shear plate 3 and the cutter 22.

In the absence of the lead cutter 24 the hair 29 would have been cut at the location A, whilst as a result of the action of this lead cutter the hair is now cut at the location B, which is situated more closely to the skin 28, yielding a better shaving result.

Figure 3:
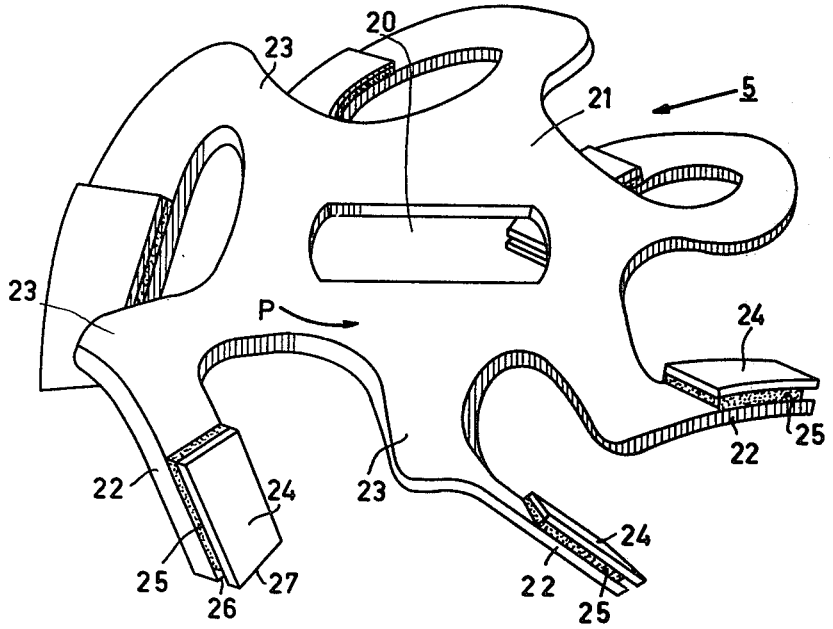
FIG. 3 is a perspective view of a cutting unit.
Figure 6:
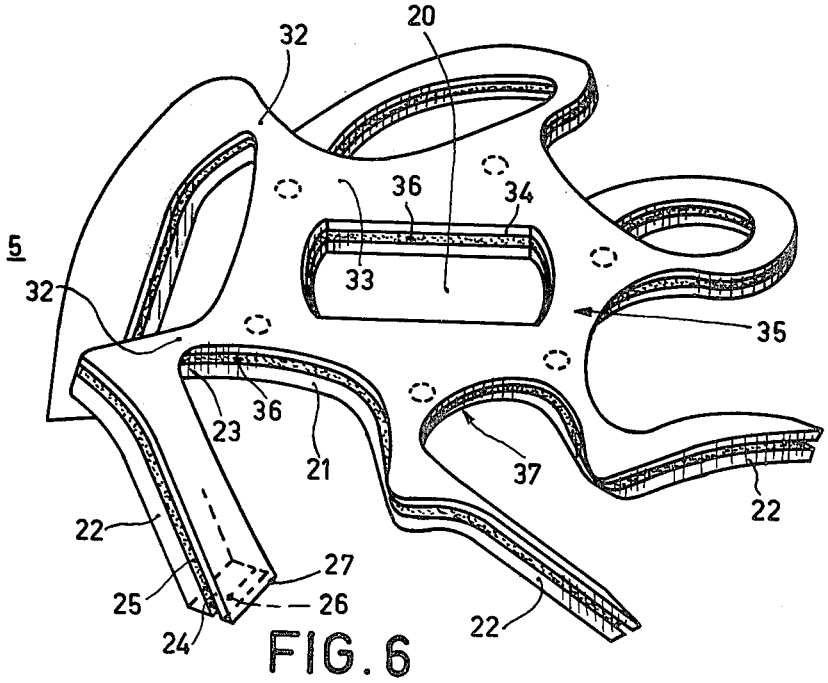
FIG. 6 is a perspective view of a variant of the cutting unit of FIG. 3.

A variant of the embodiment of FIG. 3 is shown in FIG. 6. The lead cutters 24 are now situated at the ends of the arms 32 which are integral with a central disc 33. The central disc has an opening 34 which corresponds to the coupling aperture 20. The lead cutters 24, the arms 32, and the central disc 33 are thus combined to form a lead cutter unit 35, which by means of a rubber layer 36 is isolated from the cutting member 37 constituted by the cutters 22, the arms 23, and the central body 21. The cutting unit thus formed may for example be manufactured in one operation from a sheet material which is laminated in the sequence: metal, rubber, metal.

In order to obtain satisfactory mobility of the lead cutters 24 relative to their associated cutters 22, the width of the arms 32 may be reduced substantially relative to the width of the arms 23 by a separate operation such as etching. The arms 32 may also be etched away completely.

The construction with a connecting element of a material with rubber-elastic properties between the cutter and the lead cutter may also be employed in a shaving apparatus with a reciprocating drive of the cutting unit or in a so-called wet shaver, which has no shear plate, but where the cutting unit is in direct contact with the skin.

In general a shaving apparatus as described in the foregoing has the advantages that the cutting unit can be manufactured simply and can readily be mounted in or removed from the apparatus. Moreover, the connecting element prevents contaminants from collecting between the cutter and the lead cutter.

Instead of rubber other materials with rubber-elastic properties, such as for example a plastic foam, may also be used as the material for the connecting element 25, 36.

What is claimed is:

1. A shaving apparatus having a cutting unit provided with at least one cutter, a lead cutter associated with and movable relative to the cutter, and an element connecting the lead cutter to the cutter, said connecting element comprising a layer of a material having rubber-elastic properties between the cutter and the lead cutter.

2. A shaving apparatus according to claim 1, in which the connecting element comprises a rubber layer.

* * * * *